United States Patent [19]

Gueret

[11] Patent Number: 4,470,425

[45] Date of Patent: Sep. 11, 1984

[54] SERRATED WIPER

[75] Inventor: Jean-Louis H. Gueret, Paris, France

[73] Assignee: L'Oreal, Paris, France

[21] Appl. No.: 373,538

[22] Filed: Apr. 30, 1982

[30] Foreign Application Priority Data

May 4, 1981 [FR] France ..... 81 08770

[51] Int. Cl.[3] ..... A45D 40/30

[52] U.S. Cl. ..... 132/88.5; 401/122

[58] Field of Search ..... 132/88.5, 88.7; 401/122, 129, 130; D28/7

[56] References Cited

U.S. PATENT DOCUMENTS 2,436,291 2/1948 Daniel ..... 401/122
2,627,619 2/1953 Gagen ..... 401/122 X
3,084,374 4/1963 Ziegler ..... 401/122
3,471,244 10/1969 Melocchi ..... 401/122
3,998,235 12/1976 Kingscord ..... 132/88.5

FOREIGN PATENT DOCUMENTS 2488111 2/1982 France ..... 132/88.5

*Primary Examiner*—Gregory E. McNeill
*Attorney, Agent, or Firm*—Cushman, Darby & Cushman

[57] ABSTRACT

A make-up application unit includes a make-up product container 2 and a cap 3 which incorporates an applicator brush on one end of a carrier 6,7. Surplus make-up product is wiped from the brush bristles 9 by a serrated wiper lip of a flexible wiper sleeve 10. There may additionally be a non-serrated carrier wiper lip just above the flexible serrated brush wiper lip.

15 Claims, 6 Drawing Figures

SERRATED WIPER

DESCRIPTION

The present invention concerns a make-up unit comprising a container for a make-up product and a brush able to enter the container via an opening bounded by a supple lip exerting a wiping action on the bristles of the brush, with a view to eliminating any excess make-up product drawn off by the brush within the container.

Such a unit is more particularly intended for making up eyelashes by means of an eyelash-reinforcing product known as mascara. A mascara brush of the conventional type most frequently comprises tufts of relatively long bristles arranged in rings or in a helix around the handle. The wiping device associated with this type of brush may be a rubber wiper sleeve inserted inside the neck of the container. The slim, elastically deformable bottom of the sleeve is pierced by a circular opening whose diameter is smaller than the minimum diameter of the brush measured at the tip of the bristles, so that the supple lip around the opening can exert a wiping action on the brush when the brush is withdrawn from the container. The lip in question may be slit so as to enhance its suppleness and to allow the brush to pass over the peripheral wiping lip without too much exertion.

More recently, new mascara brushes have been proposed which comprise relatively short and rigid bristles arranged along longitudinal rows around the brush handle. On a brush of this kind, the bristles are formed by closed loops of a band of material rolled, in the shape of a cone or cylinder, around the handle. The material used is known under the trade name "VELCRO".

In comparison with conventional mascara brushes, this new type of brush has the advantage that the bristles, which are hard and spaced apart, allow the eyelashes to be separated individually so that each eyelash can come to take up the make-up product which is found at the base of the rigid bristles. On the contrary, with a conventional mascara brush the bristle tufts arranged in the shape of helices or rings take several eyelashes at the same time so that the eyelashes are treated in clusters and not individually and this leads to an inferior quality of the application of make-up.

However, the wiping of these new brushes produces difficulties: in fact, the peripheral wiper lip cannot reach the bottom of the interstices arranged between the longitudinal bristle rows, because of their rigidity and also because the bristles of one and the same row are relatively close together which prevents the penetration of the supple wiper lip between the bristles of the same row. It follows that the wiper lip, if it does exert a suitable action on the end of the bristles, leaves too much make-up product in existence in the grooves situated between the bristle rows. To overcome this drawback, the inner diameter of the peripheral wiper lip may of course be reduced further but in that case the brush can be passed over across the wiper lip only with considerable effort; thus the price to pay is the detriment of ease of use. Moreover, the risks of spluttering are increased, because of the sudden return of the heavily prestressed bristles into their original position once they have passed over the wiper lip.

The object of the present invention is to mitigate the above mentioned drawbacks.

Accordingly the present invention provides a make-up unit comprising a container for a make-up product, and a brush having short substantially rigid bristles arranged in longitudinal rows on the periphery of a carrier of the said brush, wherein the container has an opening bounded by a supple, elastically deformable serrated wiper lip for wiping the brush, the teeth of said lip being capable of penetrating between two contiguous said longitudinal rows of bristles, and of coming substantially into contact by their free ends with said carrier for the bristles as the brush is passed over the serrated wiper lip. The number and dimension of the teeth of the serrated wiper lip are chosen so as to remove the excess make-up product, not only from the bristle ends by means of slots arranged between the teeth, but also from between the longitudinal rows of bristles by means of the teeth of the wiper lip. Moreover, the "in depth" wiping of the bristles of the brush may be effected practically without bending the short and rigid bristles of the brush, that is to say by exerting a relatively small pulling action to cause the brush to pass across the wiper lip and thus reduce the risks of spluttering. Moreover, if the band of the "VELCRO" material is fixed around the handle by a seam forming a longitudinal ridge on the surface of the brush, the serrated configuration of the wiper lip makes it possible to avoid any opening cut in the said seam and hence to extend the useful life of the brush.

It is preferable for the bristles of the brush to be formed by closed loops of a fabric rolled in the shape of a cone or cylinder around the end of a rod. The fabric used is advantageously that which is designated by the trade name "VELCRO" and has the property of comprising an array of closely spaced hooks to engage with suitable formations on another such fabric. The hooked sheet is the one referred to herein. Such a material is preferably made of a polyamide.

Advantageously the number of teeth of the serrated wiper lip is equal to or exceeds the number of longitudinal rows of bristles of the brush; the teeth are triangular and are substantially identical and regularly distributed over the inner edge of the serrated wiper lip. The inner diameter of the serrated wiper lip, measured at the bottom of the slots separating the teeth, is smaller than the minimum diameter of the brush measured at the bristle tips of the said brush; the inner diameter of the serrated wiper lip, measured at the tips of the teeth, is smaller than the minimum diameter of the brush measured at the base of the bristles of the said brush, i.e. at the bristle carrier or support.

Advantageously, the brush wiper is a sleeve made of a rubber composition at the bottom end of which is the serrated wiper lip, the sleeve being inserted within the neck of the container.

In the conventional way, the brush may be mounted at the end of a carrier whose other end is joined to a cap of the container. The cap screw may be fixed on the container neck, or fixed by any other appropriate means. The above-mentioned closing cap may advantageously be fixed within a cylindrical presentation cap also serving as an element for holding the brush during application of eyelash make-up.

Although the serrated wiper lip made of a rubber composition gives every satisfaction for wiping the brush, it may not ensure efficient wiping of the brush carrier. For this purpose, provision is made, in accordance with the invention, for associating the brush wiper with a complementary carrier wiper having an opening whose peripheral unserrated lip makes it possible to wipe the brush carrier, the above mentioned complementary carrier wiper lip preferably being more rigid than the serrated brush wiper lip. This greater rigidity may derive from the material itself from which the brush carrier wiper lip is made. But if the brush carrier wiper lip is made of an elastically deformable material, this greater rigidity may be procured by giving the brush carrier wiper lip a greater wall thickness.

Preferably, the diameter of the brush carrier rod measured at the outside of the brush is, on the one hand, equal to or greater than the maximum diameter of the brush measured at the tips of the bristles of the brush and, on the other hand, equal to or slightly smaller than the inner diameter of the wiper lip for the brush carrier rod. Thanks to these dimensional characteristics, the wiper lip for the brush carrier rod hardly acts on the brush and, because of its greater rigidity and its structure (a non-serrated edge), it ensures a good wiping of the brush carrier rod, without adversely affecting the wiping of the brush this function being ensured by the supple, elastically deformable serrated lip.

Another advantageous characteristic provides for the two wipers, namely for the brush and the brush carrier, respectively, to be inserted inside the container neck such that the carrier wiper lip is disposed just in the vicinity of the serrated brush wiper lip, or substantially abutting said serrated wiper lip, this serrated wiper being placed to the side of the non-serrated carrier wiper nearer the container bottom. This arrangement has the advantage that when the applicator is withdrawn from the container at the time of making up, the supple serrated brush wiper lip bears, during this movement, against the more rigid carrier wiper lip. The supple serrated lip thus has a reduced deformability when the brush is withdrawn from the container. On the other hand, when the brush is being repositioned within the container after making up, the supple serrated brush wiper lip is no longer supported by the more rigid carrier wiper lip and may therefore be freely deformed. The introduction of the brush is thereby made easier, and the wiping action exerted by the supple serrated brush wiper lip is weaker than before, which makes it possible to reduce substantially the accumulation of the make-up product within the container neck which occurs during use.

It is preferable for the brush wiper to take the form of a sleeve made of a rubber composition, such as Buna Rubber, at the bottom whereof the supple serrated wiper lip is formed. In this case, the brush carrier wiper is advantageously disposed within the above mentioned sleeve.

In a first variant the brush carrier wiper lip is a washer made of a plastic material, for instance polyethylene or polyurethane, which is inserted inside the rubbery sleeve forming the brush wiper, the above mentioned washer being fixed within the sleeve and substantially abutting its bottom end. In this case, the sleeve comprises means allowing it to be axially positioned within the container neck. The sleeve may thus be provided, at the end opposite the serrated wiper lip, with an annular flange abutting the container neck and provision may be made for projecting catches on the exterior of the sleeve to engage an inner shoulder arranged in the zone where the neck forms the container barrel.

In a second variant the brush carrier rod wiper is a thimble-shaped body of a plastic material, for instance polyethylene or polyurethane, the above mentioned thimble being inserted within the rubbery sleeve which forms the brush wiper; the above mentioned thimble comprises a peripheral side wall joined to a pierced bottom forming the brush carrier wiper lip.

In this second variant, the sleeve is advantageously fixed by snap-fit engagement around the thimble, by means of devices such as a continuous or discontinuous retaining bead in relief on the thimble for the sleeve and which engages within a complementary peripheral groove in the other. In this case, the engagement of the thimble within the container neck is ensured by means of an annular flange provided on that peripheral edge of the thimble which is opposite its bottom end, said flange abutting the rim of the neck. To prevent the extraction out of the neck of the unit formed by the sleeve catch fixed around the thimble the sleeve may comprise external catches formed in relief and capable of abutting the inner shoulder provided in the zone where the neck forms the container barrel.

In a third variant the carrier wiper is made integrally with the sleeve constituting the brush wiper and comprises at least one internal annular projecting rim arranged on the sleeve, the said rim being advantageously arranged near the bottom end of the sleeve near the supple serrated brush wiper lip. In this case, the annular rim has preferably a side wall thickness which is greater than that of the supple serrated lip in the bottom, so as to benefit from a greater rigidity ensuring a good wiping of the brush carrier.

According to another variant, the brush carrier wiper is formed not only by an inner annular rim of the sleeve but also by a washer of a plastic material additionally inserted between the bottom of the sleeve and the above mentioned annular rim.

In order that the present invention may more readily be understood there will be described below by way of purely illustrative and non-restrictive examples four embodiments, represented in the attached drawings, in which.

Figure 3:
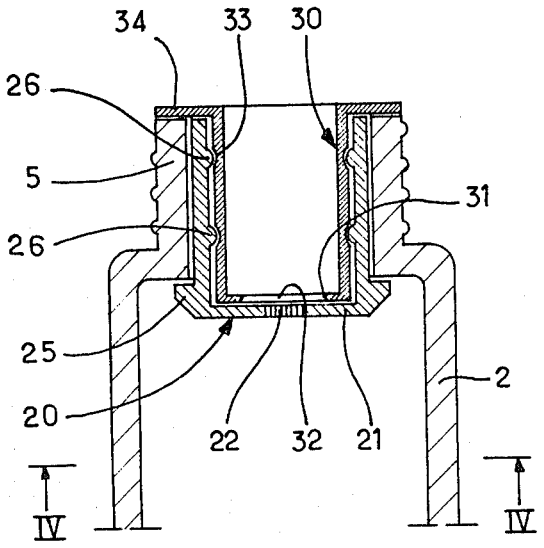
FIG. 3 is a partial cross section of a make-up unit according to the invention, fitted with two wiper devices, one for the brush and the other for the brush carrier rod, the carrier rod wiper being thimble-shaped.
Figure 5:
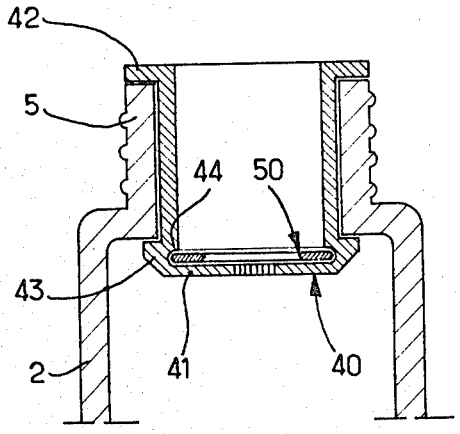
Figure 6:
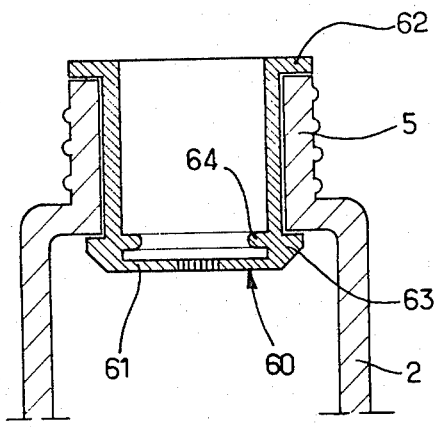

FIG. 5 is a view, similar to FIG. 3, showing a make-up unit comprising two wiper devices, one for the brush and the other for the brush carrier rod, the carrier rod wiper being in the form of a washer, and FIG. 6 is a sectional view, similar to that of FIG. 3, showing a make-up unit comprising a sleeve of a rubbery substance forming integrally the wiper device for the brush and the wiper device for the brush carrier rod.

Figure 1:
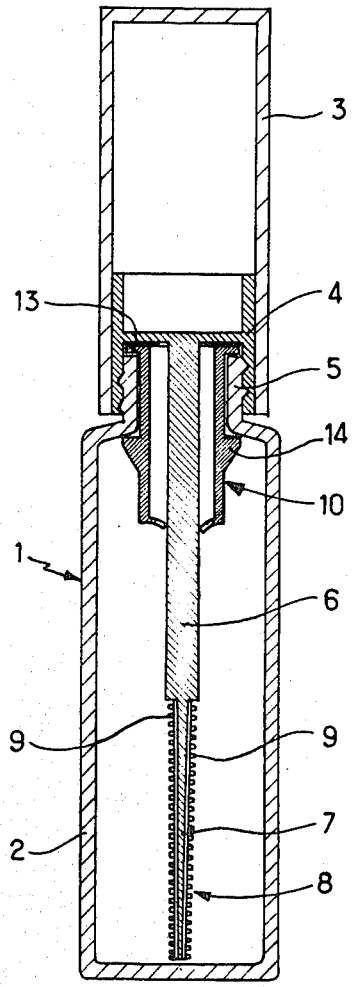
FIG. 1 is an axial cross section of a make-up unit according to the invention, without any additional wiper device for the brush carrier rod.
Figure 2:
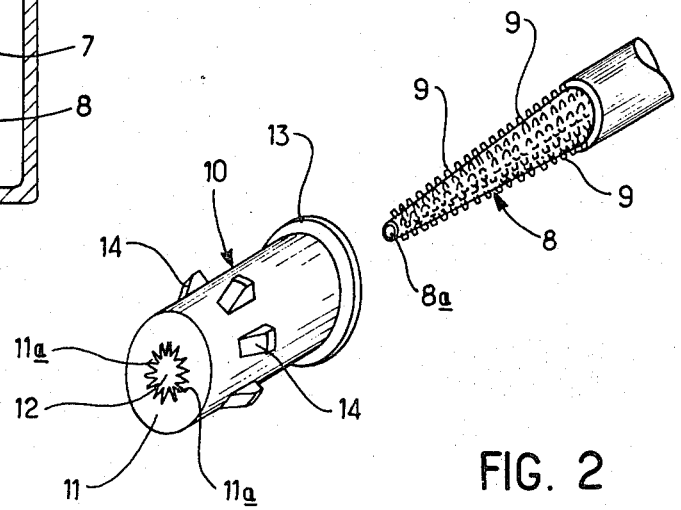
FIG. 2 is a view in perspective of the brush and of the brush wiper device of the make-up unit of FIG. 1.

Referring to FIGS. 1 and 2 of the drawing, it will be seen that a make-up unit used for applying mascara to the eyelashes has been designated as 1.

Make-up unit 1 comprises a small cylindrical stick whose bottom part is formed by a container for mascara and whose top part is formed by a cylindrical cap 3. A capsule 4 fixed within cap 3 is provided with an internal thread which cooperates with an external thread carried by neck 5 of container 2 to ensure the closure of the container. The inner capsule 4 is integral with a rod 6 ending in a slightly frustoconical end fitting 7. Rod 6 is disposed along the axis of cap 3 and projects relative thereto.

A strip of material 8, known under the trade name "VELCRO", is rolled around end fitting 7 and closed by means of a welded seam (not shown). The strip of material 8 is made of a polyamide and comprises several longitudinal rows of short, loop-shaped bristles 9. By reason of their configuration, their low height and also the material from which they are formed, the bristles 9 are substantially rigid in the sense that they practically do not bend during making-up or wiping. The rows of bristles 9 are relatively wider-spaced than are two neighbouring bristles 9 of the same row. The strip of the material with loops 8 constitutes the make-up brush. The diameter of the brush carrier rod 6 is slightly greater than the maximum diameter of brush 8 measured at the tip of bristles 9.

The wiper device for brush 8 is generally designated 10 and is a soft rubber sleeve inserted within neck 5 of the container. The bottom of the sleeve 10, which is pierced by an opening 12, forms a supple peripheral lip 11 exercising the wiping action on brush 8. On the side opposite to the peripheral lip, the sleeve 10 is provided with an annular flange 13 supported on the edge of the container neck 5. Regularly spaced out catches 14 are provided in relief on the exterior of the wiper sleeve 10.

The positioning of sleeve 10 within neck 5 of the container is made possible by deformation of its elastic side wall. Its axial support is ensured, on the one hand, by flange 13 which is supported on the edge of neck 5 and, on the other hand, by the presence of catches 14 which bear against the inner annular shoulder of the container 2 (FIG. 1).

The wiping of brush 8 in contact with the eyelash-highlighting product, such as mascara, contained in container 2 is effected each time one unscrews and separates, from container 2, the make-up applicator formed by the cap 3, the inner capsule 4 and the brush 8 carried by rod 6. A plurality of substantially identical and regularly spaced teeth 11*a* is arranged on the inner edge of wiper lip 11. The inner diameter of wiper lip 11, measured at the tips of teeth 11*a*, is slightly smaller than the minimum diameter of brush 8 (at its free end 8*a*) measured at the base of bristles 9 of the said brush. Moreover the inner diameter of wiper lip 11, measured at the bottom of the slots separating two consecutive teeth 11*a*, is slightly smaller than the minimum diameter of brush 8 at its free end 8*a*, this minimum diameter being measured at the tip of bristles 9 of the brush. It is preferable for the number of teeth 11*a* to be equal to, or better still higher than, the number of rows of bristles 9 of brush 8.

Thanks to these geometric characteristics, the wiper lip 11 makes it possible to carry out a double wiping of, on the one hand, the ends of bristles 9 between the slots separating teeth 11*a* and, on the other hand, the grooves between the longitudinal rows of bristles 9, by means of the ends of teeth 11*a* along the whole height of brush 8 which is being withdrawn from the make-up container 2. The wiping of the longitudinal grooves of brush 8 could not be effected with a non-serrated wiper lip because the rigidity of the bristles 9 of brush 8 would prevent the wiper lip from penetrating within the said grooves and from exerting an "in depth" wiping action.

Moreover, if the internal diameter of such a non-serrated lip is reduced with a view to removing the excess product accumulated within the grooves between the rows of bristles 9, the user has to exert a greater pull to extract the brush from the container; and a bending of the rigid bristles 9 may then occur as they pass over the wiper lip 11 followed by a sudden electric return into their initial positions once the obstacle has been crossed; hence the risk of splutter. On the other hand the wiper lip 11, by reason of its serrated configuration, allows any excess make-up product disposed between the rows of bristles 9 to be removed practically without prestressing the bristles 9, therefore avoiding the spluttering due to the rapid return of the said bristles when the prestressing is released.

Figure 4:
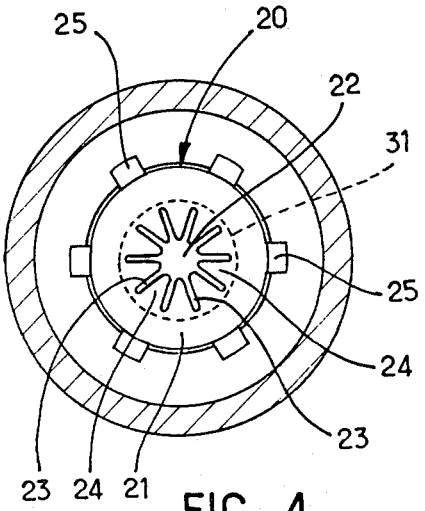
FIG. 4 is a sectional view taken along line IV—IV of FIG. 3.

Referring now to FIGS. 3 and 4 of the drawings, there will be seen a wiper device 20 for the brush and the wiper device 30 for the brush carrier rod of a make-up unit similar to that of FIGS. 1 and 2. The make-up unit of FIG. 3 is provided with the mascara container 2 and the applicator of FIG. 1, that is to say, in particular with brush 8 and the brush carrier rod 6. The outer diameter of the brush carrier rod 6 is, as in the example of FIGS. 1 and 2, slightly greater than the maximum diameter of brush 8 measured at the tips of bristles 9.

The wiper device 20 for brush 8 is also a wiper sleeve made of soft rubber which is inserted within neck 5 of the container. The substantially flat bottom 21 of the sleeve is pierced at the centre by a circular opening 22 from which there issue a multiplicity of radially extending narrow slots 23 with parallel edges. The slots 23, which are all identical, are regularly spaced out at the periphery of the circular hole 22; with the circular hole 22, they define a plurality of triangular teeth 24 with rounded tips. Thus the bottom 21 of the sleeve forms the serrated wiper lip for brush 8. The diameter of circular opening 22, that is to say the inner diameter of the serrated wiper lip 21 measured at the tips of teeth 24, is slightly smaller than the smallest diameter of brush 8 measured at the base of bristles 9 of the said brush. Moreover the inner diameter of the serrated wiper lip 21, measured at the bottom of slots 23, is slightly smaller than the smallest diameter of brush 8 measured at the tips of bristles 9 of the said brush.

Regularly spaced catches 25 are provided in relief on the exterior of sleeve 20 at the level of the serrated wiper lip 21 formed by the bottom of the sleeve. They bear on the inner shoulder joining the neck 5 to the barrel of the container 2.

The wiper device 30 for the brush carrier rod 6 is formed by a thimble-shaped body made of polyurethane or polyethylene. Bottom 31 of the thimble is pierced at its centre by a circular opening 32 with a bevelled edge. The pierced bottom 31 constitutes the peripheral wiper lip acting on the brush carrier rod 6. Such a lip, which is made of polyethylene or polyurethane, is more rigid than the serrated wiper lip 21 made of soft rubber for brush 8.

Thimble 30 is inserted within sleeve 20 so that the wiper lip 31 for the brush carrier rod can bear substantially against the serrated wiper lip 21 of brush 8.

At its end opposite to wiper lip 31, the thimble 30 is provided with a radially outwardly projecting flange 34 supported on the edge of neck 5 of the container. The sleeve 20 is engaged around thimble 30 by means of two peripheral retaining beads 26 provided in relief on the interior of the sleeve. The above mentioned two retaining beads 26 are snap-fitted within two complementary annular grooves 33 in the exterior surface of thimble 30.

The cooperation of catches 25 of the sleeve 20 with the inner shoulder of container 2 prevents the assembly formed by sleeve 20 and thimble 30 from being extracted out of the neck 5 of the container.

The inner diameter of the wiper lip 31 for brush carrier rod 6, that is to say the diameter of the circular opening 32, is slightly greater than the diameter of the serrated wiper lip 21 measured at the bottom of slots 23 although it is substantially equal, save for the clearance, to the diameter of the brush carrier rod 6. Thanks to its serrated configuration and its soft rubber nature, the wiper lip 21 makes it possible to remove the make-up product not only from the rows of bristles 9 of brush 8, but also from within the longitudinal grooves disposed between the rows of bristles 9, practically without prestressing the bristles 9. The more rigid wiper lip 31 hardly affects the wiping of brush 8 because its inner diameter is substantially equal to that of brush carrier rod 6, which itself is slightly larger than the greatest diameter of brush 8 measured at the tips of bristles 9. Thus the supple serrated lip 21 ensures the wiping of brush 8 whereas the rigid lip solely wipes the brush carrier rod 6.

Moreover, the particular disposition of the two wiper lips 21, 31 makes it possible to exert a wiping action on brush 8 which is different according to whether it is being extracted from the mascara container 2 or being inserted into the container. In fact, when the user is withdrawing brush 8 from the container 2 at the time of making up, the serrated wiper lip 21 is supported by wiper lip 31 which imparts a greater rigidity to it or makes it less susceptible to deformation. Thus there ensues an "in depth" wiping of brush 8. On the other hand when, on completion of the make-up application, the user returns brush 8 into its position within the container the serrated wiper lip 21 which is no longer supported by lip 31 puts up less resistance to the passage of brush 8; wiping is therefore less effective and the quantity of the make up product capable of accumulating within thimble 30 is therefore reduced.

Referring to FIG. 5 of the drawings, there will be seen another variant of the embodiment of make-up unit according to the invention. The make-up unit of FIG. 5 is provided with the mascara container 2 and the make-up applicator which are shown in FIG. 1, that is to say, the brush 8 and its attendant carrier rod 6. The brush wiper device 40 of brush 8 which is inserted within neck 5 is a sleeve having at its bottom end a serrated wiper lip 41 acting on brush 8. The serrated wiper lip 41 is, in all respects, identical with the wiper lip 21 described in detail in connection with FIG. 4. The axial support for sleeve 40 within the neck 5 of the mascara container is ensured by, on the one hand, a flange 42 cooperating with the rim of neck 5 and, on the other hand, several regularly spaced catches 43 cooperating with the inner shoulder of the container arranged at the zone where the neck 5 forms the barrel of the container. The sleeve 40 is obtained by the moulding of a polybutadiene elastomer shown as "Buna" rubber, having a Shore hardness of 80.

In this example, the wiper device for brush carrier rod 6 is a washer 50 made of polyurethane or polyethylene. Washer 50 is kept in place within sleeve 40, bearing against the serrated wiper lip 41 by engagement of its outer peripheral edge within a groove 44 in the zone where the serrated wiper lip 41 forms the side wall of sleeve 40.

The washer 50 has a bevelled inner edge; its inner diameter is, save for the clearance, substantially equal to that of the brush carrier rod 6 which itself is slightly greater than the greatest diameter of brush 8 measured at the tips of bristles 9. For this reason, as in the case of the make-up unit of FIGS. 3 and 4, the wiper lip formed by the substantially rigid washer 50 practically ensures wiping of only the brush carrier rod 6 whilst the wiping of brush 8 itself is effected by the supple serrated lip 41.

The make-up unit of FIG. 5 therefore offers substantially the same wiping characteristics as the make-up unit of FIGS. 3 and 4.

The further embodiment of make-up unit illustrated in FIG. 6 is also provided with the mascara container 2 and the make-up applicator shown in FIG. 1. A sleeve 60 made of a rubber composition is inserted within neck 5. The axial support of sleeve 60 within the neck 5 is ensured, as before, by means of, on the one hand, a flange 62 supported on the edge of neck 5 and, on the other hand, several regularly spaced catches 63 which cooperate with the inner shoulder of the container arranged in the zone where the neck 5 forms the barrel of the container.

The bottom end 61 of the sleeve has a serrated edged opening which is similar in all respects to that of bottom end 21 of the sleeve described in connection with FIGS. 3 and 4. It forms the serrated wiper lip for the brush 8. In this example, the wiper lip for the brush carrier rod 6 is formed by a continuous annular rim 64 provided in relief on the interior surface of the wiper sleeve near its bottom end 61. Save for the clearance, the inner diameter of the annular rim 64 is substantially equal to that of the brush carrier rod 6, which itself is slightly greater than the greatest diameter of brush 8 measured at the tips of bristles 9. The annular rim 64 has a greater rigidity than the bottom end 61 of the sleeve, because it is not serrated and also because of the fact that its wall thickness is substantially greater than the wall thickness of bottom end 61.

To enhance the wiping of the brush carrier rod 6, a washer of a plastic material, similar to washer 50 equipping the make-up set of FIG. 5, may be added; this washer being disposed within the sleeve between its bottom end 61 and the annular rim 64. This embodiment of FIG. 6 has the special advantage of a lower cost since the sleeve of rubber composition defines both the wiper device for brush 8 and the separate wiper device for the brush carrier rod 6.

It shall be duly understood that the embodiments described above are in no way restrictive and may give rise to any desirable modifications, without thereby departing from the scope of the invention as defined by the following claims.

I claim:

1. In a make-up unit comprising a container for a make-up product, and a brush comprising a carrier rod having short and substantially rigid bristles having distal ends and having proximal ends arranged along longitudinal rows on the periphery of the said brush carrier rod; means defining an opening to permit insertion of said brush within the container and extraction therefrom; and supple, elastically deformable wiper lip means bounding said opening for wiping of said brush, during insertion and extraction thereof, the improvement comprising a serrated profile to said wiper lip means, said serrated profile comprising teeth capable of penetrating between two contiguous longitudinal rows of bristles and of coming substantially into contact at their free ends with the proximal ends of said bristles when the brush is passed wipingly over said serrated wiper lip means.

2. A make-up unit according to claim 1, wherein said brush comprises a rod having an end fitting, and the bristles of said brush are constituted by closed loops of a material rolled conically or cylindrically on said end fitting.

3. A make-up unit according to claim 2, wherein the inner diameter of the serrated lip (11, 21, 41, 61) measured at the bottom of the slots separating the teeth (11*a*, 24) is smaller than the minimum diameter of the brush (8) measured at the tip of bristles (9) of the said brush.

4. A make-up Unit according to claim 3, wherein the serrated wiper lip means has an inner diameter, measured at the tip of the teeth, which is smaller than the minimum diameter of the brush measured at the proximal ends of bristles of said brush.

5. A make-up unit according to claim 2, wherein the material used is "VELCRO".

6. A make-up unit according to any one of claims 1 to 5, wherein the number of teeth of the serrated wiper lip means is equal to or greater than the number of said longitudinal rows of bristles of the said brush.

7. A make-up unit according to any one of claims 1 to 5, wherein said teeth are triangular in shape and are substantially identical and regularly distributed on the radially inner edge of the serrated wiper lip means.

8. A make-up Unit according to one of claims 1 to 5, and further including complementary wiper means defining an opening bounded by a peripheral lip which is not serrated and achieves wiping of said brush carrier rod, the peripheral lip of said complementary wiper means having a greater rigidity than the serrated wiper lip means.

9. A make-up unit according to claim 8, wherein said brush carrier rod has an external diameter which is, on the one hand, at least as great as the maximum diameter of the brush measured at the distal ends of the bristles of said brush and, on the other hand, no greater than the inner diameter of the peripheral lip of said complementary wiper means.

10. A make-up unit according to any one of claims 1 to 5, wherein said serrated wiper lip means and a complementary wiper means are inserted within a neck of the container, said complementary wiper means being disposed in the immediate vicinity of the serrated wiper lip means with said serrated wiper lip means on the side of the complementary wiper means which is nearer the bottom of the container.

11. A make-up unit according to claim 10, wherein said complementary wiper means is in contact with said serrated wiper lip means.

12. A make-up unit according to claim 10, wherein said serrated wiper lip means is a sleeve made of a rubber composition and having said serrated profile at a bottom end thereof, said complementary wiper means being inserted within said sleeve.

13. A make-up unit according to claim 12, wherein said complementary wiper means is a washer inserted within said sleeve defining the serrated wiper lip means, said washer being fixed within the said sleeve substantially in contact with its bottom end.

14. A make-up unit according to claim 12, wherein said complementary wiper device means is a thimble-shaped body inserted within said sleeve defining the serrated wiper lip means, said thimble-shaped body comprising a peripheral side wall connected to a pierced bottom wall which serves to wipe the brush carrier rod.

15. A make-up unit according to claim 10, wherein said serrated wiper lip means and said complementary wiper means are integrally formed as a sleeve of a rubber composition, having at its bottom end means defining the opening with the serrated lip therearound, and wherein said complementary wiper means comprises at least one annular rim provided in relief on the interior surface of said sleeve.

* * * * *